United States Patent [19]

Max et al.

[11] Patent Number: 4,683,450

[45] Date of Patent: Jul. 28, 1987

[54] LINE WITH DISTRIBUTED LOW-PASS FILTER SECTION WHEREIN SPURIOUS SIGNALS ARE ATTENUATED

[75] Inventors: Jean-Joseph Max, Neuchatel; Arvind Shah, Cormondreche, both of Switzerland

[73] Assignee: Feller AG, Horgen, Switzerland

[21] Appl. No.: 509,217

[22] Filed: Jun. 29, 1983

[30] Foreign Application Priority Data

Jul. 1, 1982 [CH] Switzerland ..... 4021/82

[51] Int. Cl.[4] ..... H01P 1/201

[52] U.S. Cl. ..... 333/202; 333/206; 333/12; 333/181

[58] Field of Search ..... 333/12, 181, 182, 243, 333/245, 206, 202, 35, 81 A; 174/32, 34, 36

[56] References Cited

U.S. PATENT DOCUMENTS

| | | | |
|---|---|---|---|
| 2,267,371 | 12/1941 | Bushbeck | 333/245 X |
| 2,411,555 | 11/1946 | Rogers | 333/202 |
| 2,438,367 | 3/1948 | Keister | 333/35 X |
| 2,438,913 | 4/1948 | Hansen | 333/206 |
| 2,577,510 | 12/1951 | Cohn | 333/206 |
| 2,641,646 | 6/1953 | Thomas | 333/206 |
| 2,700,136 | 1/1955 | Devot | 333/206 |
| 3,144,624 | 8/1964 | Rypinski, Jr. | 333/206 |
| 3,189,847 | 6/1965 | Rymaszewski | 333/12 X |
| 3,219,951 | 11/1965 | Clark | 333/12 X |
| 3,384,061 | 5/1968 | Hanysz | 333/12 X |
| 3,600,711 | 8/1971 | Gerlack | 333/81 A X |
| 3,909,755 | 9/1975 | Kaunzinger | 333/206 |
| 4,347,487 | 8/1982 | Martin | 333/243 X |
| 4,376,920 | 3/1983 | Smith | 333/12 |

FOREIGN PATENT DOCUMENTS

| | | | |
|---|---|---|---|
| 2533248 | 2/1976 | Fed. Rep. of Germany | 333/81 A |

*Primary Examiner*—Eugene R. LaRoche
*Assistant Examiner*—Benny Lee
*Attorney, Agent, or Firm*—Kinzer, Plyer, Dorn & McEachran

[57] ABSTRACT

For suppression of high-frequency spurious signals (noise) present on an electrical transmission line, the line incorporates at least one section comprising a distributed low-pass filter. This section is constructed so that its wave impedance ($Z_1$) has a different value than the wave impedance ($Z_0$) of the neighboring line sections. This filter line section additionally provides considerable dielectric losses and/or skin effect losses. At both ends of the filter line section, at which the wave impedance changes, multiple reflections arise that attenuate the high-frequency spurious signals (noise). The dielectric or skin effect losses produce strong attenuation of the undesired resonances that arise from the reflections, as well as further attenuation of spurious signals in the highest frequency region.

11 Claims, 12 Drawing Figures

Fig. 5
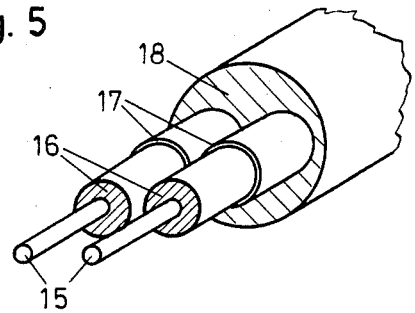
Fig. 6
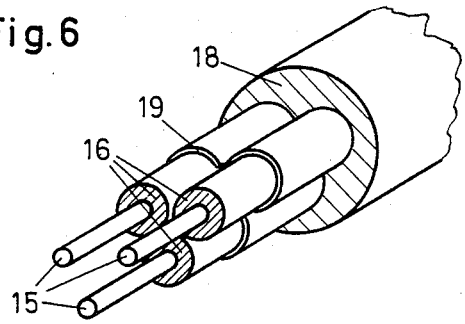
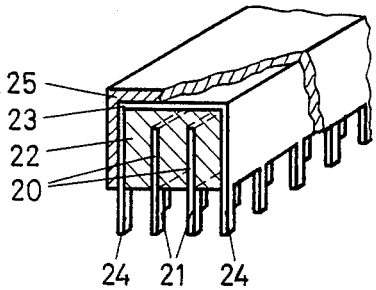
Fig. 7
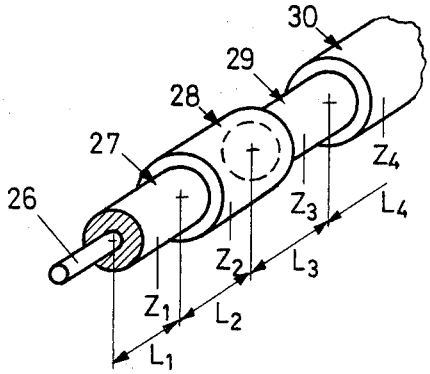
Fig. 8

LINE WITH DISTRIBUTED LOW-PASS FILTER SECTION WHEREIN SPURIOUS SIGNALS ARE ATTENUATED

BACKGROUND OF THE INVENTION

The invention concerns an electrical transmission line with at least one distributed low-pass filter to suppress high-frequency spurious signals (noise) present on the line.

Known noise protection filters with discrete circuit elements, which can be ohmic, capacitive and inductive, as one chooses, have a drawback in that the parasitic inductances connected to their capacitive circuit elements, or the parasitic capacitances connected to their inductive circuit elements, give rise to undesirable resonances in the region of high frequencies.

Shielded electrical lines with at least one distributed low-pass filter used as noise protection filters are known from the journal IEEE Transactions on Electromagnetic Compatibility, January 1964, pages 55 to 61, and from the journal Proceedings of the IEEE, January 1979, pages 159 to 163, and from West German Patent No. 29 39 616. In the first-cited literature source, a coaxial transmission line is described which has one or several line sections with a magnetic material, such as a ferrite material, between the central conductor and the external shielding as lossy insulation material. A similar coaxial noise protection filter, equipped with a magnetic ceramic material, essentially proposed as a feed-through filter, is described in the second-named literature source. In German Patent No. 29 39 616 a lossy electrical cable is described in which at least one conducting element is used in connection with an absorbing mixture at least partially surrounding the conductor and having a composite construction, namely a core formed of a filament or a fiber and a conductive coating of the type such that the element exhibits high resistance with good mechanical properties.

The known distributed low-pass or noise protection filters exhibit drawbacks in that they must exhibit high magnetic losses, dielectric losses or conductive losses in the insulation material, since only such high losses produce the desired low-pass effect, and that they have a sophisticated design that hampers not only their manufacture but also their universal applicability.

SUMMARY OF THE INVENTION

The purpose of the present invention is to create an electrical line incorporating a distributed low-pass filter with a low cut-off frequency as well as a high attenuation without notable resonance phenomena for signals in the highest frequency range, using a simple construction requiring neither the use of materials with high losses nor great lengths.

According to the invention, by combining reflections on both sides of a line section of different impedance with dielectric losses and/or skin effect losses in this same line section, it is possible to achieve a reciprocal increase in these two individual attenuation effects, for higher frequencies. On the one hand, multiple (in optimum cases almost total) reflections of the high-frequency signals are produced on the ends of the cited line sections of different impedances thus considerably increasing the path lengths for these signals; on the other hand, the losses in this line section are also increased owing to the greater equivalent path lengths thus obtained in the lossy line section. In addition, by proper choice of dielectric for the lossy line section, i.e., proper choice of its dielectric constant, a proportionately lower cut-off frequency of the low-pass filter can be achieved, together with a proportionately higher resonance frequency. In addition, a line can be manufactured with one line section, or, to increase the noise protection filter effect, with several consecutive line sections of different impedances and higher dielectric losses or skin effect losses, in a relatively simple fashion and in virtually any length so that the present line can be used as a noise protection filter that allows an electrical current of low frequency or a D.C. component to pass without notable attenuation, but with high attenuation for high-frequency currents.

BRIEF DESCRIPTION OF THE DRAWINGS

Versions of the object according to the invention will be explained using the accompanying drawings, in which:

FIG. 5 and FIG. 6 show cut-away views of two-wire and three-wire coaxial cables, respectively, for practical implementation of the invention;

FIG. 7 shows a sectional view of a power distributing bus for practical implementation of the invention;

FIG. 8 shows a partial view of a coaxial cable with several line sections of different impedance;

DESCRIPTION OF THE PREFERRED EMBODIMENTS

Figure 1:
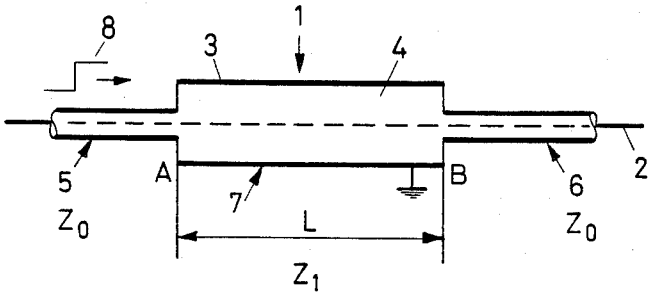
FIG. 1 shows a schematic representation of a line according to the invention with a lossy line section, of different impedance from adjacent sections of the line, affording a distributed low-pass filter in the line.

FIG. 1 schematically depicts a coaxial line 1, which in a known fashion includes a main conductor 2, an outer conductive shield 3, and an insulation material or dielectric 4 (not shown) between conductor 2 and the outer shield 3. The line 1 includes first and second line sections 5 and 6, both of which have a characteristic impedance $Z_0$ and a loss factor tan $\delta_O$, which equals zero in the present example (loss-free line sections). In between we find a third line section 7, whose impedance $Z_1$ markedly differs from $Z_0$ and which has a relative dielectric constant $\epsilon_r$ and a loss factor tan $\delta_1$, and whose length equals L.

When a signal 8, which is represented in FIG. 1 as a unit voltage step function signal and which propagates onto line section 5 of impedance $Z_0$, reaches point A of line 1, the beginning of line section 7, at which the impedance suddenly assumes value $Z_1$, part of the signal is reflected, whereas the other part propagates onto line section 7. At point B of line 1, the end of line section 7 at which the impedance suddenly reassumes value $Z_0$, further reflection of part of the signal occurs, the other part of which propagates onto line section 6. The reflected part of the signal, which preferably constitutes nearly all of the remaining signal, is returned to point A, where nearly total reflection again occurs. Thus, multiple reflection of the signal components, as shown in greater detail in FIG. 2, occurs in line section 7, because this section has a different impedance in comparison with the neighboring line sections 5 and 6.

Figure 2:
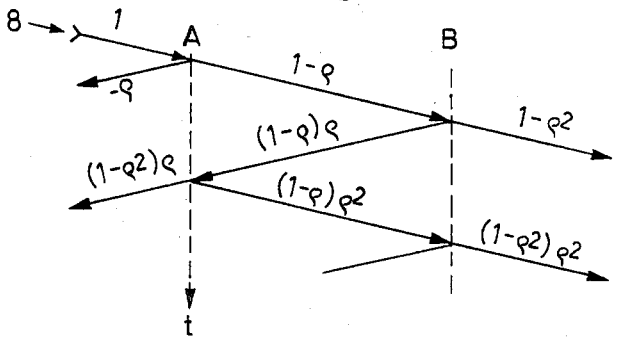
FIG. 2 shows a schematic representation of signal reflections on the ends of the filter section of FIG. 1.

In FIG. 2 the reflected and transmitted parts of the unit step function signal 8 that reaches point A in line section 7 are represented as a function of time t. The respective amplitudes of the individual reflected or transmitted signal parts are given in terms of the reflection factor $\rho$, for which the following relationships apply:

$$\rho = (Z_0 - Z_1)/(Z_0 + Z_1)$$

Reflection factor from $Z_1$ in a direction toward $Z_0$.

$$1 - \rho = 2Z_1/(Z_0 + Z_1)$$

Transmission factor from $Z_0$ in a direction toward $Z_1$.

It will be assumed here that only the TEM mode of line 1 is considered.

Figure 3:
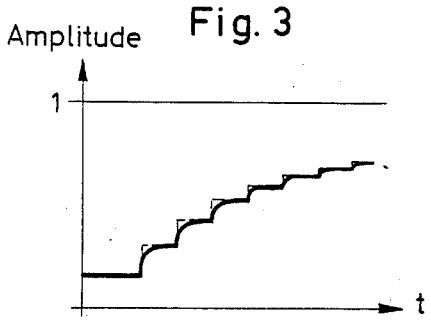
FIG. 3 shows an example of the response to a unit voltage step function signal applied to the end of the filter section of FIG. 1.
Figure 4:
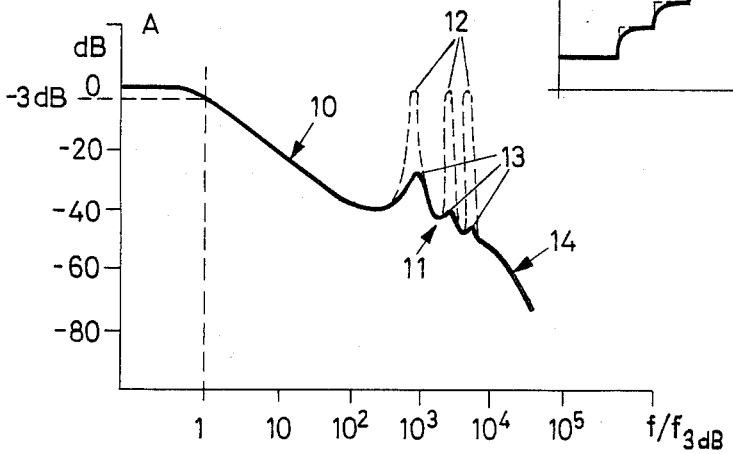
FIG. 4 shows an example of the filter attenuation as a function of frequency for a line according to FIG. 1.

The signal parts that appear successively at the junction between line section 7 with impedance $Z_1$ and subsequent line section 6 with impedance $Z_0$ and that are then transmitted onto line section 6, therefore form a step-shaped curve, in which the signal amplitude of the first step amounts to $1-\rho^2$, that of the second step $(1-\rho^2)\rho^2$, etc., assuming that line section 7 is not provided with substantial dielectric losses. Such an original response curve to the unit step function signal 8 is shown by the broken line in FIG. 3. In the case of dielectric losses being present in line section 7, i.e., in case that $\tan \delta_1 \neq O$, the solid line shown in FIG. 3 is observed as response on line section 6. It is therefore obvious that a marked low-pass effect is achieved by the combination of repeated reflections with the dielectric losses of line section 7, as is illustrated in FIG. 4. This low-pass effect is based on the fact that not only merely a small part of the unit step function signal 8 enters line section 7 of different impedance but, in addition, this small part must pass back and forth several times over this line section before it can produce a notable voltage at the output of line section 7, and that finally the effect of dielectric losses in this line section is increased, because the "equivalent length" of the line section is multiplied by a factor that is essentially inversely proportional to the very small value $1-\rho$. This equivalent length is thereby defined as the average path length that the pulse-shaped wave must cover during repeated back and forth movements along the same line section 7 until half of the wave finally emerges from this line section and is passed on, onto the next line section.

As already noted, resonances occur in line section 7, of different impedance $Z_1$, at higher frequencies, and these resonances are essentially undesirable because they reduce the attenuation at certain frequencies. It can be shown that the amplitudes of such resonances can be significantly reduced or entirely suppressed by the effect of dielectric losses in line section 7.

FIG. 4 shows the calculated and experimentally established curve of filter attenuation versus frequency for a line according to FIG. 1; here the attenuation A in dB and the frequency f relative to the cut-off frequency $f_{3\,dB}$ (i.e. relative to the frequency at which the attenuation is 3 dB) are plotted on a logarithmic scale.

It is therefore apparent from FIG. 4 that in the first region 10 of the filter curve an attenuation with a slope of nearly 20 dB per decade of frequency is observed because of the reflections in line section 7. In the subsequent region 11 of the filter curve, high resonance peaks 12 will be observed as long as the dielectric losses in line section 7 are absent; but these peaks will appear only as minor bumps 13 once substantial dielectric losses are introduced. In the last region 14 of the filter curve, which can lie above 1 GHz, the attenuation exhibits an even higher slope, because the dielectric losses prevail there.

It can be demonstrated by calculation that the total attenuation expressed in dB as a sum of three terms (in the following one assumes $Zo > Z1$):

(a) a first term, governed by reflections, given by $+20.\log[1/(1-\rho^2)]$in which $\rho$ denotes the already cited reflection factor, in region 10 of FIG. 4;

(b) a second term, governed by the dielectric losses, given by $+8.67\ \pi f\, T_d \tan \delta_1$ in which f is the frequency, $T_d$ the delay of line section 7 and $\tan \delta_1$ the loss factor of line section 7, in region 14 of FIG. 4;

(c) a third term, governed by the resonances, given by $-20.\log(|F|)$ in which F is a value that varies depending on frequency f, loss factor $\tan \delta_1$ and delay $\tau_d$, the absolute value of F being $\geqq 1$ in region 11 of FIG. 4. This third term is negative, i.e., it produces a reduction of attenuation.

Here the delay $T_d = L/v$, i.e. it is the product of the length L of line section 7 and the inverse propagation velocity 1/v in this section.

Thus, the reflections produced by the different impedance in line section 7 determine the filter slope and, as will be explained, the cut-off frequency of the low-pass filter, whereas elimination or at least strong attenuation of the resonances produced by the reflections and a more pronounced weakening in the direction of higher frequencies is obtained by the dielectric losses of line section 7 which, in their turn, increase with increasing frequency.

The cut-off frequency of this low-pass filter is given by $f_{3\,dB} = (1-\rho)/2\pi \cdot T_d$.

The frequency of the n-th resonance is given by $f_{rn} = n/2 \cdot T_d$.

Since, on the one hand, the cut-off frequency should be as low as possible and, on the other hand, the frequency of the first resonance (n=1) as high as possible, an optimum cannot be achieved by simply choosing a certain delay $t_d$ (i.e., by simply choosing the length L of the line section or the propagation velocity v in the line section) since both $f_{3\,dB}$ and $f_{rn}$ are proportional to $1/T_d$. A high ratio of $f_{rn}$ to $f_{3\,dB}$ can therefore be achieved only via the reflection factor $\rho$ which should be as close as possible to one.

The reflection factor $\rho$ depends, on one hand, on a pronounced change in dielectric constant $\epsilon_r$ and, on the other hand, on a pronounced change in geometry of the line at the end of line section 7. Since the dielectric constant can only be altered over a fairly narrow range, it is preferable to produce a significant increase in the ratio of frequency $f_{rn}$ of the first resonance to cut-off frequency $f_{3\,dB}$ by proceeding in such a way that, in addition to the length L of the line section, the two other dimensions, i.e., the transverse dimensions, are changed; for example, one changes the diameter of the transmission line.

In order to achieve the different impedances $Z_0$ and $Z_1$ for line sections 5, 6 and 7 in the line 1 depicted in FIG. 1, insulation materials 4 with different relative dielectric constants can be used for these line sections. An additional and important measure, with respect to the above-mentioned determination of the cut-off frequency of the low-pass filter by different dielectric constants of line sections 5 and 6 from section 7, the line geometry along line 1 can also be changed, for example, by changing the diameter of insulation material 4. The loss factor tan δ of line section 7 should be sufficiently high so as to obtain sufficient attenuation of the undesired resonances. Special measures in material selection, for example magnetic materials are not necessary, however. Furthermore, the entire line 1, including line sections 5 and 6, can, if desired, also exhibit the same loss angle tan δ. Polyethylene with tan δ between 0.02 and 0.2, or polyvinylidene fluoride (PVDF) with tan δ between 0.1 and 0.2 in the frequency range from 0.5 to 200 MHz, are examples of suitable insulation materials for the lossy line section 7 with different impedance $Z_1$.

The line 1 shown only schematically in FIG. 1 can be made in different versions depending on its intended use, three examples of which are shown in FIGS. 5, 6 and 7. In the sectional views only one of the line sections 5, 6 and 7 of FIG. 1 is shown.

For use of the line as a line noise filter for electrical and electronic devices, one version involves a multiwire, shielded power cable according to FIGS. 5 and 6. FIG. 5 shows a two-wire line with two main conductors 15, each of which is surrounded by insulation material 16 of a specified diameter and specified dielectric properties. A separate metallic shield 17 encloses each insulation material 16. A plastic protective cover 18 is also provide. FIG. 6 shows a similar arrangement with three conductors 15, but in which one conductive shield 19 is common for the three insulation materials 16 of all three conductors 15. The version according to FIG. 5 is suitable for use as an antiparasitic signal or data line, whereas the version according to FIG. 6 is especially suited for use as an antiparasitic power cable for building and house installation.

The present line can also be in the version of a distributing bus for power supply within or outside of electrical and electronic devices, as shown in FIG. 7. Two main conductors 20, equipped with connectors 21, are embedded in an insulation material 22 of specified dimensions and specified dielectric properties. The insulation material 22 is enclosed by a shielded metal housing 23, open only on the bottom, which is equipped with a larger number of connectors 24 and surrounded by a plastic protective cover 25.

In order to increase the filter effect, it is preferable to provide several lossy line sections of different impedance along the line, rather than a single distributed filter line section 7 according to FIG. 1. FIG. 8 depicts such an arrangement in a coaxial cable, in which the shielding and protective cover are removed. This cable consists of a central main conductor 26 and several line sections 27, 28, 29, 30, etc. made of insulation material, corresponding to impedances $Z_1$, $Z_2$, $Z_3$, $Z_4$, etc., and corresponding to lengths $L_1$, $L_2$, $L_3$, $L_4$, etc. It is also apparent that line sections 27, 28, 29, 30 have different diameters. In addition, the dielectric constants of the insulation materials of these line sections, as well as their loss angles are generally different. In practice it is often desirable to make every alternate section identical with respect to its diameter and the dielectric constant and loss angle of its insulation material. Lengths $L_1$ to $L_4$ can therefore all be different from one another in order to avoid the possible and disturbing accumulation of individual disturbing effects (e.g. resonances) due to the reflections. In practice, lengths $L_1$ to $L_4$, as well as length L according to FIG. 1, can have values between about 1 cm and 500 cm, so that at limited lengths the present line can also have the form of a discrete noise protection filter component for electrical and electronic devices, for example, for a printed circuit.

In a similar simplified cascade arrangement, in which with reference to FIG. 1, a line section with impedance $Z_1$ and a loss factor tan $\delta_1$, follows a line section with impedance $Z_0$, a line section with impedance $Z_0$ is connected to this and this is again followed by a line section with impedance $Z_1$ and loss factor tan $\delta_1$, etc. such that the already cited attenuation terms (a) and (b) are multiplied by the number of lossy line sections $Z_1$ and thereby the filter effect is greatly increased.

In the previously described versions of the invention, it is assumed that the distributed low-pass filter has uniform distributed impedances and uniform losses. If, on the other hand, we consider the behavior of any electrical component with respect to very rapid pulses or high frequencies, we see that in the sense of the word "discrete", circuit components such as inductances and capacitors are no longer present, but that one only has distributed elements in either regular or irregular fashion.

If a discrete inductance is connected at the end of a line section with a specified wave impedance, then the attenuation curve of this device can be obtained, for the higher frequencies that need to be attenuated, from the consideration that the inductance is a distributed element whose wave impedance varies as a function of the coordinates between an initial point and the end of the inductance.

To approximate such a variable impedance, we may take simply the average value, which is designated as the "equivalent wave impedance". The cited arrangement therefore represents a line that has a first line section with an equivalent wave impedance $Z_{equiv}$, a second line section with an equivalent wave impedance $Z_{equiv'}$, and a third line section, between the two, with a wave impedance Z. Thus, we have again a line with discontinuously changing wave impedances, at the points where the wave impedance varies, that can be calculated as in the preceding versions.

Approximate values of the average equivalent wave impedance for inductances (H) and capacitors (C) are given by the relations $$Z_{equiv}(H)=H\cdot v/1 \text{ or } Z_{equiv}(C)=1/C\cdot v,$$

in which 1 is the length of the corresponding line segment and v the propagation velocity, dependent on the insulation material. In the case of an inductance H the length is equal to the wire length, whereas in the case of a capacitor C the length 1 is equal to the total length, if it is a wound capacitor, or to its average length, if it is not a wound capacitor.

Figure 9:
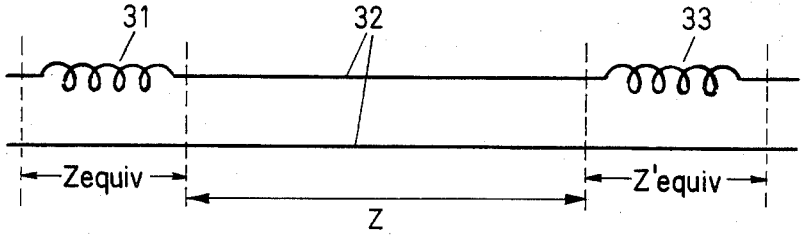
FIG. 9 shows a line with two discrete inductances at its ends, each exhibiting an equivalent wave impedance.

FIG. 9 shows a version of the electrical line according to the invention in which a first line section has a discrete inductance 31, the intermediate third line section is formed by coaxial cable 32, and a second line section has an additional discrete inductance 33; here the third line section has a wave impedance Z and the neighboring first and second line sections have equivalent wave impedances $Z_{equiv}$ and $Z'_{equiv}$ that are substantially different from Z.

Figure 10A:
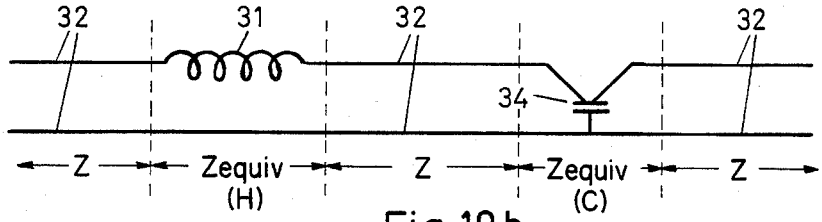
FIG. 10*a* shows a line with a discrete inductance and a discrete capacitor at its ends, both of which exhibit an equivalent wave impedance.
Figure 10B:
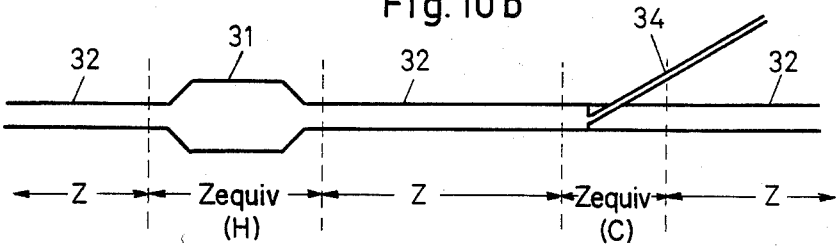
FIG. 10*b* shows an equivalent representation of the line of FIG. 10*a* as a line with varying wave impedances.

FIG. 10*a* shows a similar design of a line in which the corresponding second line section has a capacitor 34. In terms of impedances, this version corresponds to the line depicted in FIG. 10*b* whose successive line sections have the equivalent wave impedance $Z_{equiv}$(H), the wave impedance Z and the equivalent wave impedance $Z_{equiv}$(C). The capacitor 34 in this case functions in the same role as an open stub line. As shown in FIGS. 10*a* and 10*b*, the overall line can consist of several alternating line sections of the described type.

As an alternative to the described versions in FIGS. 9 and 10, which are provided with dielectric losses, the known skin effect which is effective at higher frequencies can also be utilized in order to achieve in simple fashion losses that strongly attenuate the undesired resonances which are formed as a result of signal reflections thus exhibiting once again the desired filter attenuation as in the previously described lines, for the high-frequency region (FIG. 4). The measures used to produce frequency-dependent losses based on the skin effect may consist of a design wherein the main conductor of the line has an inner conductive part (a core) with high electrical conductivity in order to conduct relatively lower frequencies, from direct current up to a few thousand Hertz, without loss. The inner conductive part may thus have a coating or a surface layer that has lower electrical conductivity or is semiconductive, in which the currents of higher frequency flow as a result of the skin effect. Since this coating is a poor conductor, the current conducting layer or skin becomes thinner at high or very high frequencies than in the case of a full conductor made of a conductive material, so that current conduction is further hampered, i.e., the losses that develop owing to the skin effect are much greater.

Dielectric losses increase proportionally with frequency, but losses due to the skin effect only increase with the square root of frequency. Since, however, as will be explained, the above-mentioned coating can have a much lower electrical conductivity than, for example, copper, the achievable skin effect losses are sufficient to produce the desired filter attenuation.

Figure 11:
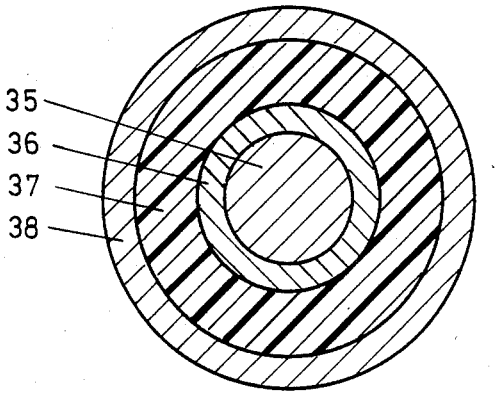
FIG. 11 shows a section through the cable of a line whose losses depend on the skin effect.

FIG. 11 shows a section through a corresponding line. An inner main conductor core 35 consists of an electrically conductive material, e.g., copper with an electrical resistivity of 1.7 $\mu\Omega$·cm. The inner conductor 35 has a thin surface layer 36 made of a poorly conducting metal, e.g., antimony (electrical resistivity 42 $\mu\Omega$·cm)
bismuth (electrical resistivity 120 $\mu\Omega$·cm)
nichrome (electrical resistivity 100 $\mu\Omega$·cm)
manganese (electrical resistivity 70 $\mu\Omega$·cm).

The surface layer can also consist of a semiconductive material, preferably cuprous oxide $Cu_2O$.

Around the surface layer 36 a layer 37 of insulation material is provided, and this layer is, in its turn, encased by a shielding conductor 38 with high electrical conductivity, made for example also of copper. By this simple design of the line the properties of the central conductor which conducts signals of relatively low frequency are preserved with a simultaneous high attenuation of signals of higher and highest frequency.

The inner conductor 35 can also be equipped with several thin outer layers of a poor conductor, such that the resistivity of the layers increases in the outward direction. This insures that at high frequencies the current will penetrate only the most poorly conducting outer conductor.

It is understandably also possible to combine the previously described dielectric losses with the skin effect losses, namely by proper choice of insulation material and coating material of the central conductor.

We claim:

1. An electrical transmission line comprising an elongated main conductor of low resistivity and including first and second line sections, each section including a segment of the main conductor and each section having a predetermined characteristic impedance; and a distributed low-pass filter comprising a third line section connected in series between the first and second line sections, the third line section including a main conductor segment interconnecting the main conductor segments of the first and second line sections, the third line section having a characteristic impedance substantiallly different from the characteristic impedance of either one of the first and second line sections so that high frequency spurious signals occurring on the transmission line are repetitively reflected back and forth within the third line section, and the third line section having a layer of non-magnetic conductive material, having a resistivity many times higher than the resitivity of the main conductor segment of the third line section, encompassing the main conductor segment of the third line section, affording substantial losses for such high frequency spurious signals so that such signals are highly attenuated as they are reflected within the third line section.

2. An electrical transmission line according to claim 1 in which the high resistivity non-magnetic conductive layer in the third line section is encompassed by a lossy dielectric layer to further increase attenuation at high frequencies.

3. An electrical transmission line according to claim 1 in which the characteristic impedances of the first and second line sections are equal to each other.

4. An electrical transmission line according to claim 1 and further comprising:

a four line section having a construction corresponding to that of one of the first and second line sections and having a predetermined characteristic impedance;

and a second distributed low-pass filter comprising a fifth line section connected in series between the second and fourth line sections, the fifth line section having a construction corresponding to that of the third line section and having a characteristic impedance substantially different from that of either one of the second and fourth line sections.

5. An electrical transmission line according to claim 4 in which the characteristic impedances of the first, second, and fourth line sections are all equal to each other and in which the characteristic impedance of the third and fifth line sections are equal to each other.

6. An electrical transmission line comprising an elongated, continuous, unitary main conductor of low resistivity and uniform dimensions throughout the line, a conductive shield disposed in at least partially encompassing, spaced relation to the main conductor throughout its length, and a dielectric interposed between the main conductor and the shield, the transmission line including first and second line sections, each such section including a segment of the main conductor and a segment of the shield and each such section having a predetermined characteristic impedance, the transverse dimensions of the shield and the dielectric respectively being the same in each of the first and second line sections, a distributed low-pass filter comprising a third line section interposed in series between the first and second line sections, the third line section including a main conductor segment interconnecting the main conductor segments of the first and second line sections, a conductive shield segment disposed in at least partially encompassing spaced relation to the main conducor segment of the third line section and electrically conductively interconnecting the shield segments of the first and second line sections, and a dielectric interposed between the main conductor and shield segments throughout the length of the third line section, the third line section having transverse dimensions for its shield segment and its dielectric that are respectively different from those for the first and second line sections, the third line section having a characteristic impedance substantially different from the characteristic impedance of either one of the first and second line sections, such that high frequency spurious signals occurring on the transmission line are repetitively reflected back and forth through the third line section, the third line section affording substantial non-magnetic losses for the high frequency spurious signals so that such signals are highly attenuated as they are reflected within the third line section, the first and second line sections each being much longer than the third line section and the characteristic impedances of the first and second line sections being equal to each other.

7. An electrical transmission line according to claim 6, in which the dielectric in the third line section is a lossy dielectric having a dielectric constant different from the dielectric in the first and second line sections.

8. An electrical transmission line according to claim 6, and further comprising:

a fourth line section having a construction corresponding to that of one of the first and second line sections and having a predetermined characteristic impedance, and a fifth line section, connecting the second line section in series with the fourth line section, the fifth line section having a construction corresponding to that of the third line section and having a characteristic impedance substantially different from that of either one of the second and fourth line sections, affording a second distributed low-pass filter in the line, the first, second, and fourth line sections each being much longer than either of the third and fifth line sections and the characteristic impedances of the first, second, and fourth line sections all being equal to each other.

9. An electrical transmission line according to claim 8 in which the characteristic impedances of the third and fifth line sections are equal to each other.

10. An electrical transmission line comprising an elongated main conductor of low resistivity, a conductive shield disposed in at least partially encompassing, spaced relation to the main conductor throughout its length, and a dielectric interposed between the main conductor and the shield, the transmission line including first and second line sections, each section including a segment of the main conductor and a segment of the shield and each such section having a predetermined characteristic impedance, and a distributed low-pass filter comprising a third line section interposed in series between the first and second line sections, the third line section including a main conductor segment interconnecting the main conductor segments of the first and second line sections, a conductive shield segment disposed in at least partially encompassing spaced relation to the main conductor segment of the third line section and electrically conductively interconnecting the shield segments of the first and second line sections, and a dielectric interposed between the main conductor and shield segments throughout the length of the third line section, a non-magnetic conductive layer having a resistivity many times greater than the resistivity of the main conductor segment of the third line section encompassing the main conductor segment of the third line section between that main conductor segment and the dielectric of the third line section, the third line section having a characteristic impedance substantially different from the characteristic impedance of either one of the first and second line sections such that high frequency spurious signals occurring on the transmission line are repetitively reflected back and forth through the third line section, the third line section affording substantial non-magnetic losses for the high frequency spurious signals so that such signals are highly attenuated as they are reflected within the third line section, the first and second line sections each being much longer than the third line section and the characteristic impedances of the first and second line sections being equal to each other.

11. An electrical transmission line according to claim 10 in which the non-magnetic conductive layer between the main conductor segment and the dielectric in the third line section is a plurality of successive layers of increasing resistivity from the main conductor segment outwardly to the dielectric.

* * * * *